US006449926B1

(12) United States Patent
Focke et al.

(10) Patent No.: US 6,449,926 B1
(45) Date of Patent: Sep. 17, 2002

(54) PROCESS AND APPARATUS FOR PRODUCING (CIGARETTE) PACKS

(75) Inventors: Heinz Focke, Verden; Henry Buse, Visselhövede; Gisbert Engel, Essel, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/488,529

(22) Filed: Jan. 21, 2000

(30) Foreign Application Priority Data

Jan. 27, 1999 (DE) ..... 198 03 232

(51) Int. Cl.[7] ..... B31B 1/46; B31B 3/44

(52) U.S. Cl. ..... 53/462; 493/162; 493/167; 493/174; 493/911; 493/910

(58) Field of Search ..... 53/462; 493/143, 493/167, 170, 171, 174, 910, 911, 162

(56) References Cited

U.S. PATENT DOCUMENTS

| | | | | | |
|---|---|---|---|---|---|
| 4,056,047 | A | * | 11/1977 | Grimm | 493/102 |
| 4,163,352 | A | * | 8/1979 | Ganz | 53/393 |
| 4,241,827 | A | * | 12/1980 | Focke | 206/248 |
| 4,731,047 | A | * | 3/1988 | Lobb | 493/10 |
| 4,861,325 | A | * | 8/1989 | DiMarzio et al. | 493/124 |
| 5,336,154 | A | * | 8/1994 | Focke et al. | 493/352 |
| 5,439,167 | A | * | 8/1995 | Focke et al. | 206/268 |
| 5,584,389 | A | * | 12/1996 | Focke et al. | 206/256 |
| 5,876,319 | A | * | 3/1999 | Holton | 493/120 |
| 6,267,715 | B1 | * | 7/2001 | Sass et al. | 493/119 |

FOREIGN PATENT DOCUMENTS

| | | |
|---|---|---|
| DE | 37 40 920 | 6/1989 |
| DE | 41 00 783 | 7/1992 |
| DE | 44 04 278 | 8/1995 |
| EP | 680821 | 11/1995 |
| GB | 838385 | 6/1960 |

* cited by examiner

*Primary Examiner*—Rinaldi I. Rada
*Assistant Examiner*—Gloria R. Weeks
(74) *Attorney, Agent, or Firm*—Sughrue Mion, PLLC

(57) ABSTRACT

Process and apparatus for producing (cigarette) packs with supporting protrusions (17), formed within the pack, above a base wall (16), the supporting protrusions (17) being formed by folding webs (19). The folding webs (19) or folding tabs are pre-folded or folded definitively, during the (customary) transportation of the blanks along a blank path (25), by corresponding folding elements, in particular by a folding wheel (32) with a folding protrusion (34) which folds the folding web (19).

3 Claims, 7 Drawing Sheets

24
27
33
44
30
29
25
32
28
31
26

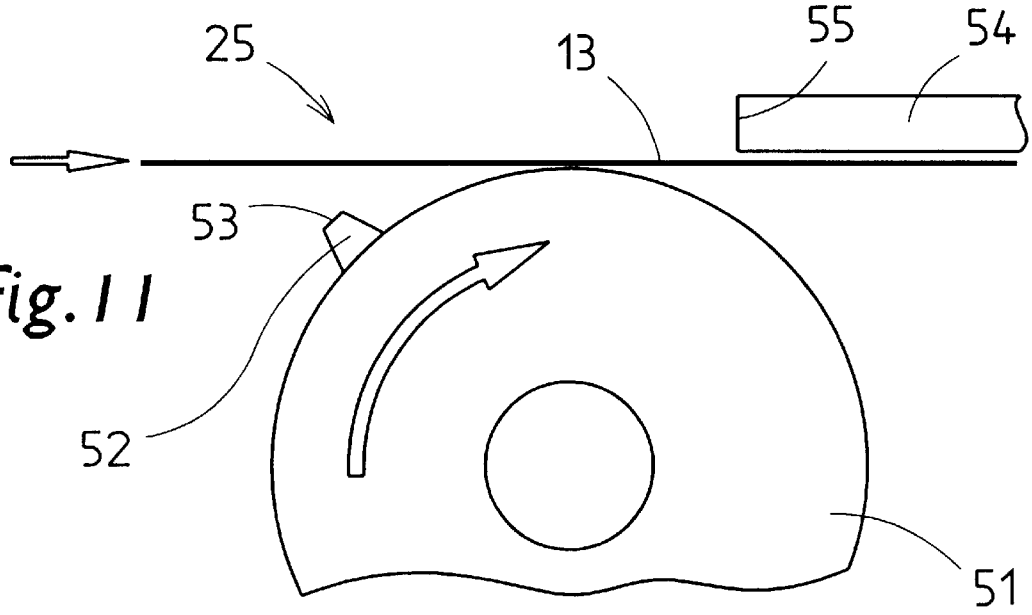
Fig. 11
Fig. 13
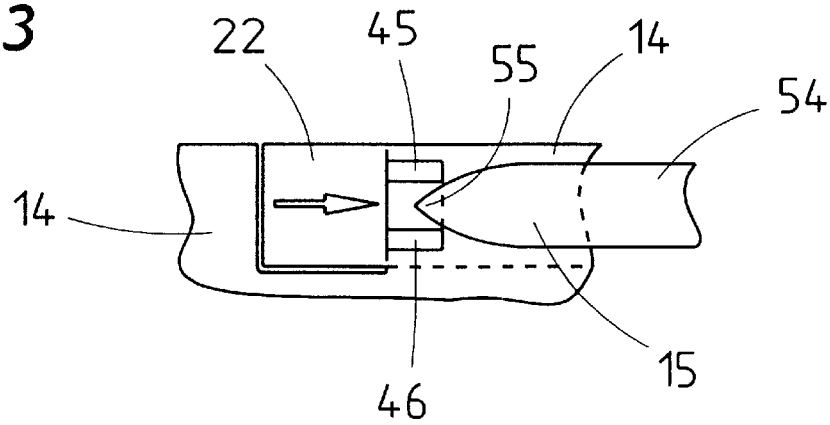
Fig. 12
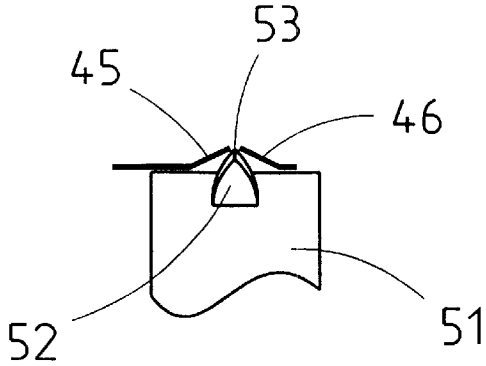

Fig. 14
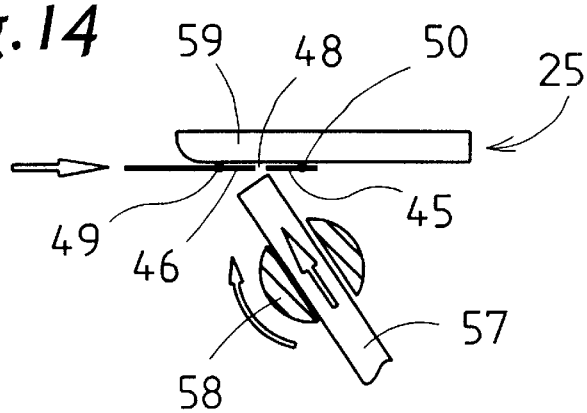
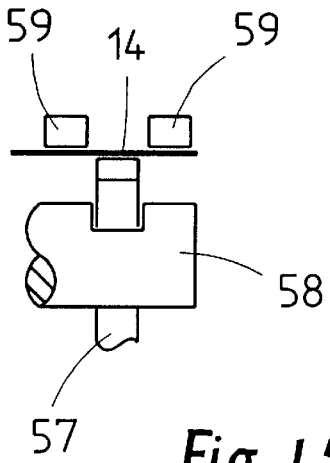
Fig. 15
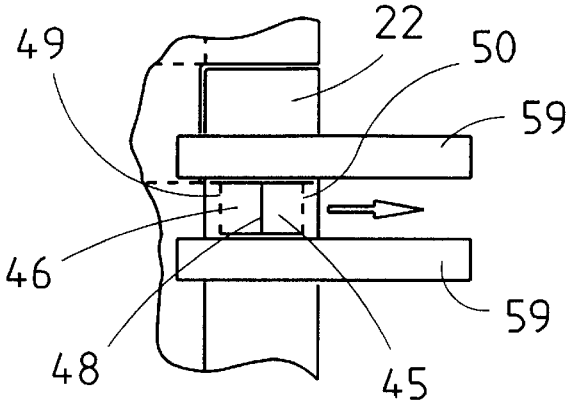
Fig. 16
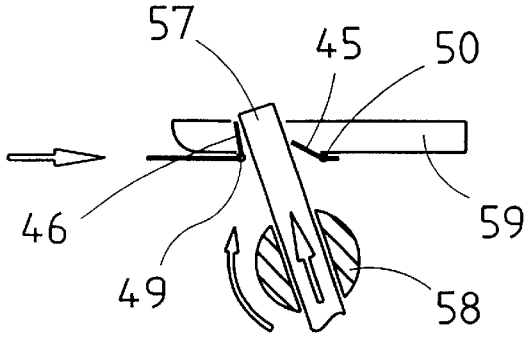
Fig. 17
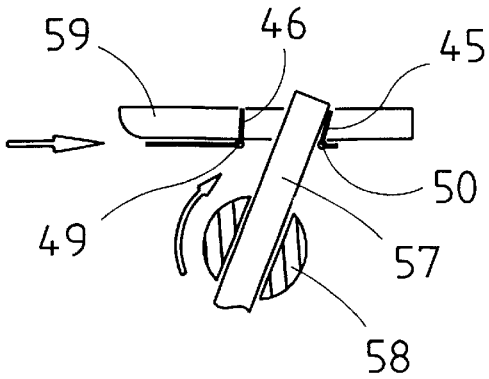
Fig. 18

PROCESS AND APPARATUS FOR PRODUCING (CIGARETTE) PACKS

BACKGROUND OF THE INVENTION

The invention relates to a process for producing (cigarette) packs from blanks made of (thin) cardboard or similar packaging material, there being arranged within the packs protrusions which are formed by folding tabs or folding webs of the blank, in particular supporting protrusions in the region of a base wall for supporting the pack contents, namely a cigarette block. The invention also relates to an apparatus for carrying out the process.

The main concern here is the production of cigarette packs of the hinge-lid-box type of the design according to U.S. Pat. No. 4,241.827. In the case of this known cigarette pack, protrusions are formed in the region of the base wall by folding webs or folding tabs, and the cuboidal pack contents, namely a cigarette group enclosed by an inner wrapper, rest thereon. The supporting protrusions cause pack contents, of relatively small dimensions, to assume a correct position, in particular in relation to a lid.

DETAILED DESCRIPTION OF THE INVENTION

The invention deals with the production of packs of this type or of similar type.

The object of the invention is to incorporate the production of the supporting protrusions within the pack in an expedient manner in the production process of said pack.

In order to achieve this object, the process according to the invention is characterized in that the folding tabs or folding webs, for forming the supporting protrusions, are deformed at least partially from the planar or largely non-folded blank.

The invention preferably proceeds such that, during the transportation of the non-folded blank along a blank path, the folding tabs or folding webs are folded definitively or at least pre-folded and folded definitively during the continued folding operation of the blanks. The folding or pre-folding takes place during the continuous transportation of the blanks along the blank path. The predetermined production process for the packs is thus not adversely affected by the provision of the supporting protrusions.

The apparatus according to the invention, namely a sub-region of the packaging machine for (cigarette) packs, comprises a horizontal or inclined blank path for the transportation of the (largely) non-folded blanks. Arranged in the region of the blank path are stationary, but movable folding and/or shaping elements which cause the folding tabs or folding webs to be folded and/or shaped during the movement of the blanks. The folding can be finished thereafter, in particular in the region of a folding turret or during the transfer of the blanks to said folding turret.

Further details of the invention relate to the configuration of the folding and/or shaping elements for the folding tabs or folding webs and to the integration of these elements in the packaging machine for the production of the relevant packs.

BRIEF DESCRIPTION OF THE INVENTION

The production process and exemplary embodiments of the apparatuses according to the invention are explained in more detail hereinbelow with reference to the drawings, in which:

FIG. 1 shows a perspective illustration of a non-yet finished cigarette pack of the hinge-lid-box type, FIG. 2 shows a portion of a blank for a hinge-lid-box according to FIG. 1, FIG. 3 shows a sub-region of a packaging machine in side view and in vertical section, FIG. 4 shows a detail of the packaging machine in side view and along the section plane IV—IV in FIG. 5, FIG. 5 shows the detail from FIG. 4 in an axis-perpendicular view, FIG. 6 shows a further detail of the apparatus in the region where the blank is introduced into a folding turret, FIG. 7 shows the detail according to FIG. 6 in a transverse view, with vertical sectioning, FIG. 8 shows the detail according to FIGS. 6 and 7 in plan view, FIG. 9 shows an illustration of a cigarette pack analogous to FIG. 1 for a different exemplary embodiment, FIG. 10 shows part of a blank for a pack according to FIG. 9, FIG. 11 shows a processing unit for a blank according to FIGS. 9 and 10, FIG. 12 shows a detail of the element according to FIG. 11 in a transverse view, FIG. 13 shows a further detail of the unit according to FIG. 11, FIG. 14 shows another embodiment of a processing unit for blanks for packs according to FIG. 9 in side view, FIG. 15 shows a transverse view of the apparatus according to FIG. 14, FIG. 16 shows a plan view of FIGS. 14 and 15, FIG. 17 shows an illustration analogous to FIG. 14 in a different position, and FIG. 18 shows yet another position of an element of the unit according to FIG. 17.

BRIEF DESCRIPTION OF THE DRAWINGS

The examples illustrated in the drawings deal with the production of a design detail of cigarette packs of the hinge-lid-box (hinge-lid-pack) type. Such packs comprise a blank made of thin cardboard. The pack itself forms a (bottom) box part 10 and a lid 11 connected thereto. The box part 10 comprises a front wall 12, a rear wall 13 and narrow, upright side walls, which each comprise an inner side tab 14 and an outer side tab 15. When the pack is in the finished state, these butt against one another over the entire surface area and are connected to one another by adhesive bonding.

Lateral supporting protrusions 17 are formed in the region of a base wall 16. Said supporting protrusions serve for supporting the pack contents, namely a cuboidal cigarette block 18.

Figure 1:
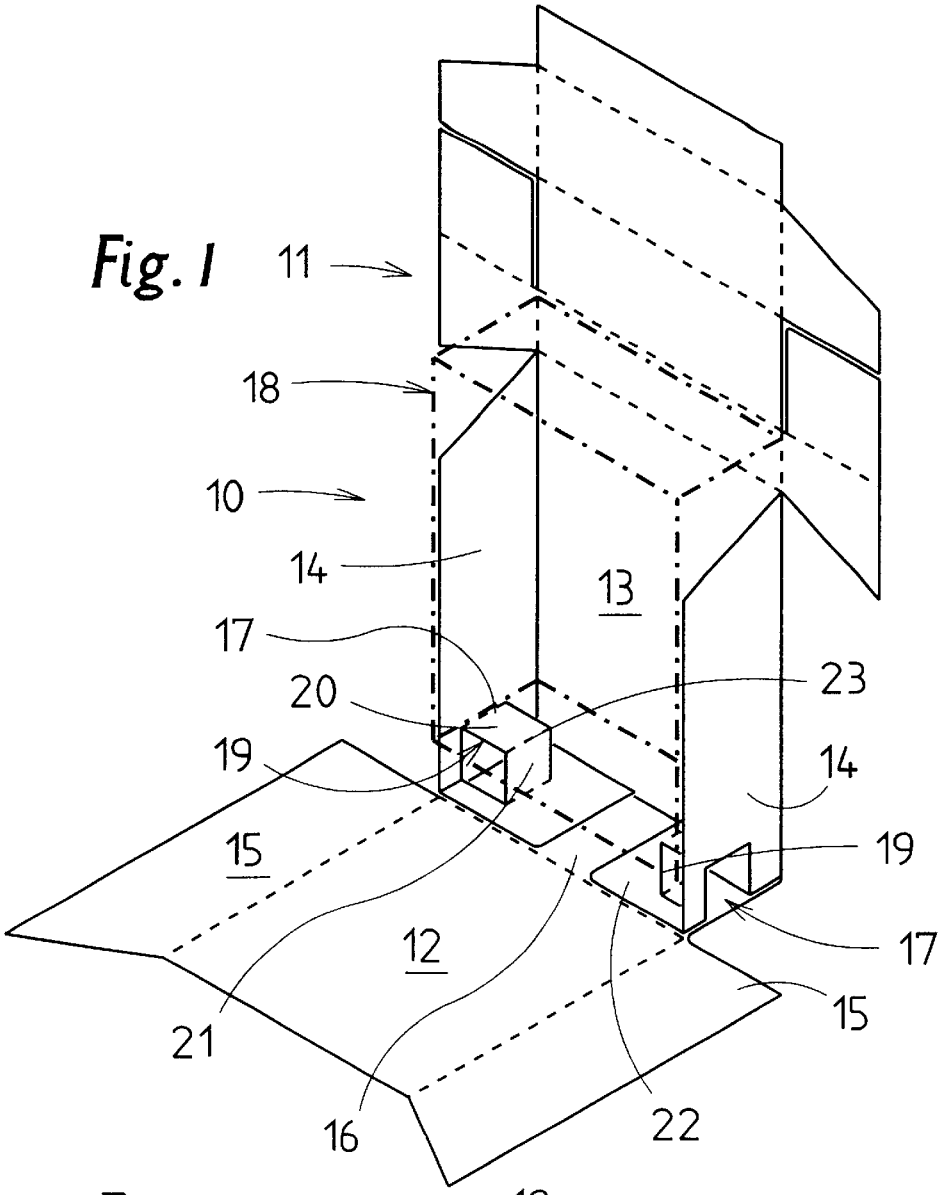
Figure 2:
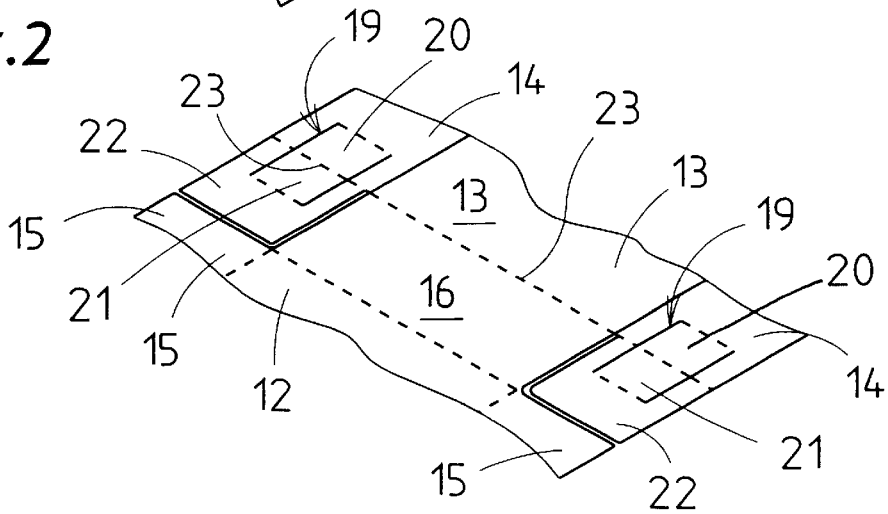

In the case of the exemplary embodiment according to FIGS. 1 and 2, the two lateral supporting protrusions comprise a folding web 19 which is folded in angle form. Said folding web comprises two legs 20, 21 which extend, on the one hand, in the region of the side tabs 14 and, on the other hand, in the region of base-side corner tabs 22, which are connected to the inner side tabs 14. A folding line 23 between the side tabs 14 and corner tabs 22 separates from one another the legs 20, 21, which are to be folded into an angled position.

The operation of providing the supporting protrusions 17 or folding the folding web 19 is integrated in the production process of the pack. The procedure is such that the folding webs 19 are pre-formed in the non-folded state of the blank, in particular by virtue of the folding lines which bound the legs 20, 21 being broken. Thereafter, that is to say when the rest of the blank is folded, the folding web 19 is folded into the position for forming the supporting protrusions 17.

The blanks for the hinge-lid-box are removed from a blank magazine 24 and introduced into a blank path 25 which is inclined downwards in the conveying direction. Said blank path comprises bottom guides 26 and top guides 27, between which the blanks are guided by way of sub-regions. The blank path 25 runs above a folding turret 28, which is of plate-like design and is driven in rotation in a horizontal plane. The folding turret 28 has a plurality of pockets 29 into which in each case one blank is introduced from above. The introduction element, namely a pivotably mounted pressure-exerting plate 30, grips the blank in the region of the rear wall 13 and, if appropriate, adjacent regions of the lid 11. By virtue of pivoting movements, the blank is moved downwards, by the pressure-exerting plate 30, out of the region of the blank path 25 into the pocket 29 positioned therebeneath, parts of the blank being folded at the same time, this resulting in an L-shaped position of the blank corresponding to FIG. 1. As far as the elements described are concerned, in particular as far as the folding turret 28 and the blank path 25 are concerned, the packaging machine is designed in accordance with U.S. Pat. No. 4,084,393.

Folding elements are arranged in the region of the blank path 25 in order to pre-fold or fold definitively the folding webs 19 or folding tabs for the supporting protrusions 17.

Figure 3:
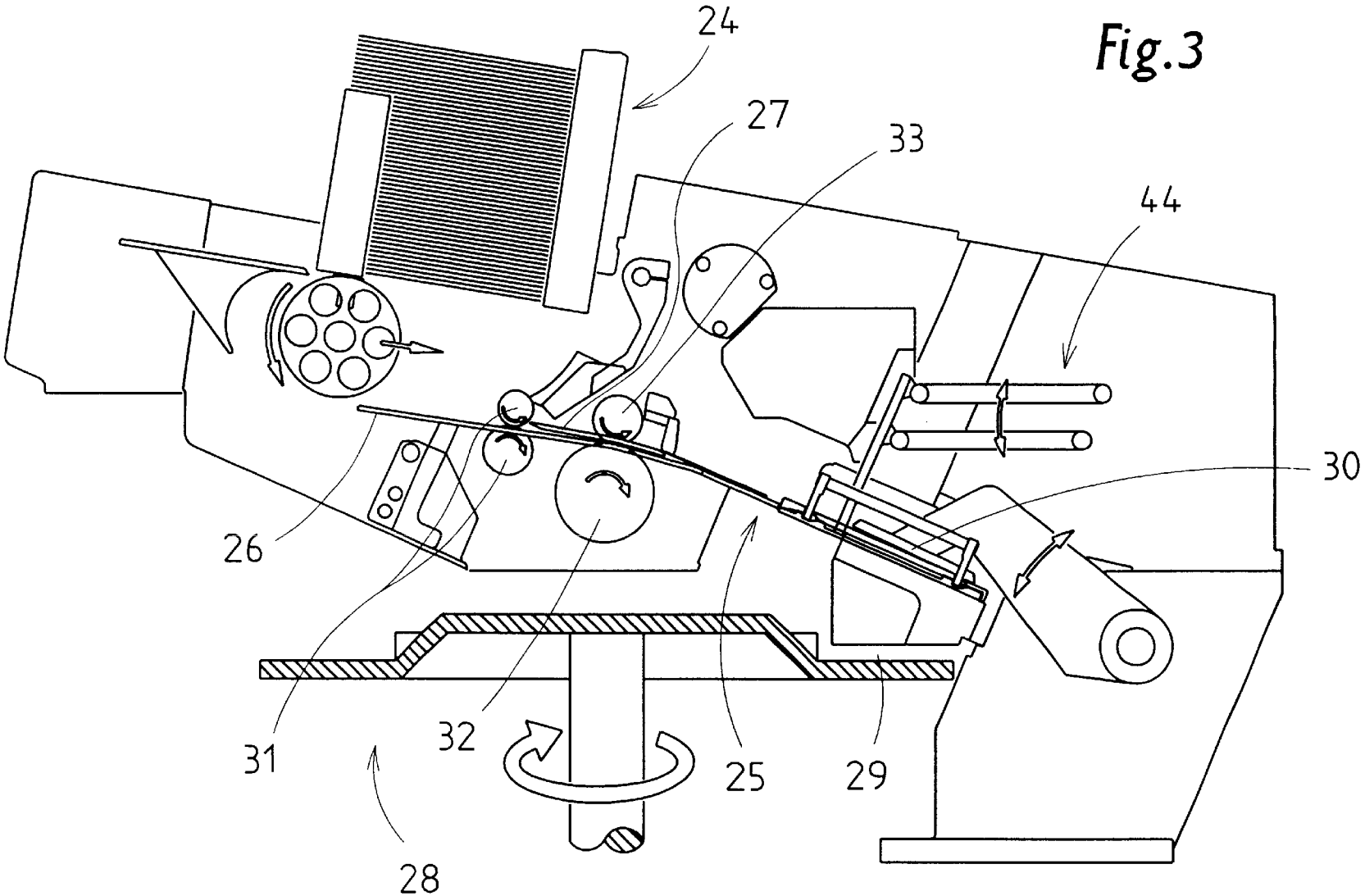
Figure 4:
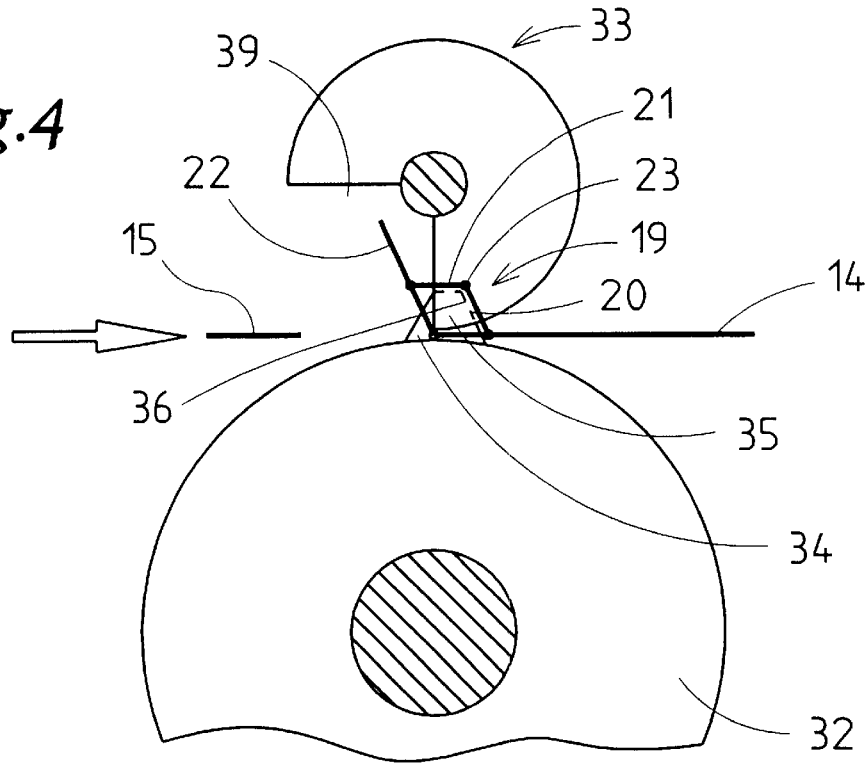

According to FIG. 3, the blanks set down on the blank path 25 are transported by conveying rollers 31. Following said conveying rollers, there is arranged beneath the movement plane of the blanks a folding element for the blanks, namely a folding wheel 32, and a mating element, namely a mating wheel 33, is arranged above the movement path. These two elements pre-fold the folding web 19, to be precise by breaking the material in the region of folding lines. In this case, the folding web 19 is at least partially put into the upright position, to be precise with the corner tab 22 being carried along into an upright or oblique position in the process (FIG. 4). Thereafter, the folding web 19 and corner tab 22 are moved back into the planar, starting position, to be precise by the bottom guide 26 and top guide 27. A largely planar blank is thus conveyed into the position above the folding turret 28.

Figure 5:
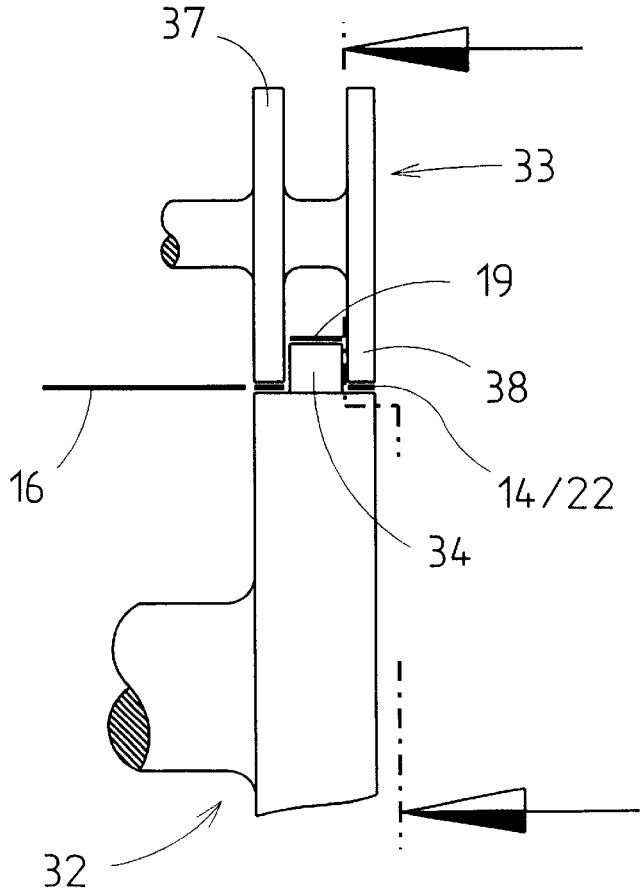

In order to carry out the (pre-)folding of the folding web 19, the folding wheel 32 is provided with a folding protrusion 34 on the circumference. During the rotation of the folding wheel 32, said folding protrusion moves, with accurate positioning, from beneath against the blank in the region of the folding web 19. The folding protrusion 34 is geared to the dimensions of the folding web 19, that is to say it is of approximately the same width (FIG. 5). The folding protrusion 34 is of trapezoidal design in cross section. A flank 35, which is located at the front in the direction of rotation, grips the leg 20 of the folding web 19 and presses it upwards on account of the relative movement. A transverse edge 36 of the folding protrusion 34 acts in the region of the folding line 23, with the result that, by virtue of the configuration of the folding protrusion 34, the folding web 19 is shaped into the configuration shown in FIG. 4. The connection to the corner tab 22 means that the latter is automatically put in the upright position as well.

In order to ensure correct (pre-)folding of the folding web 19, the mating wheel 33 presses the blank, namely the side tab 14, against the circumferential surface of the folding wheel 32 and secures said region of the blank against being raised up or put into the upright position. For this purpose, the mating wheel 33 comprises two wheel discs 37, 38, between which the folding protrusion 34 can be moved. The wheel discs 37, 38 extend on both sides of the folding protrusion 34 and/or of the folding web 19, with the result that the blank is subjected to a counterpressure in the region alongside the folding web 19 (FIG. 5).

Figure 6:
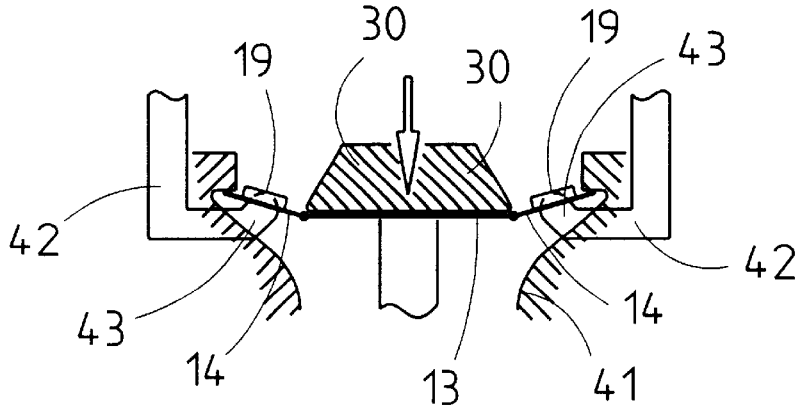
Figure 8:
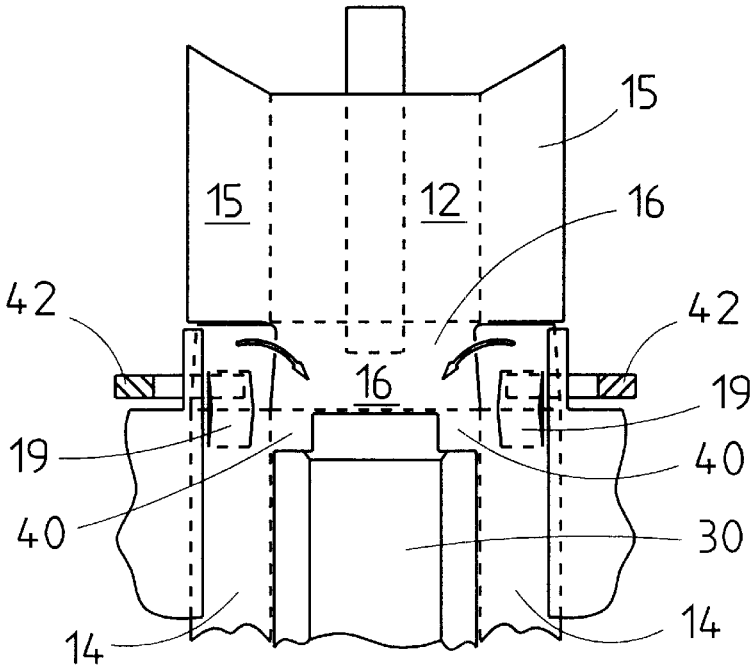
Figure 7:
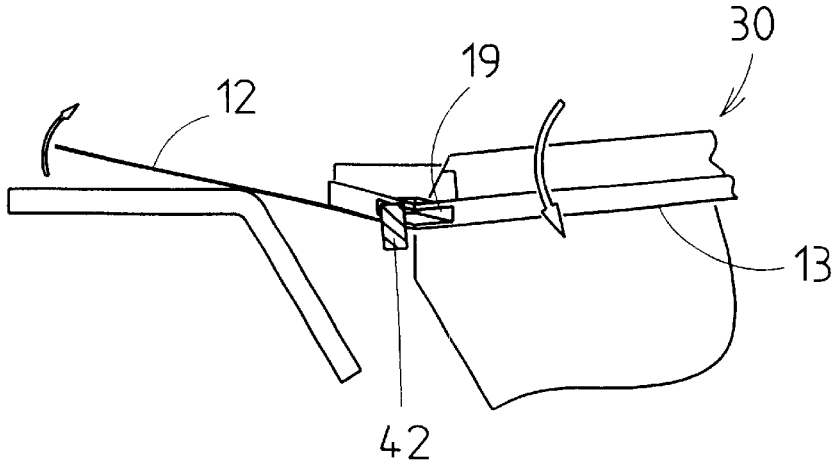

The mating wheel 33 and its wheel discs 37, 38 are provided with a segment-like cutout 39. The latter is positioned such that the corner tab 22 being put into the upright position passes into said cutout 39 during the folding operation. On account of the configuration of the supporting protrusion 17 according to FIG. 1, said protrusion is folded as the side tab 14 and the corner tab 22 are folded and/or put into the upright position. This folding operation is performed as the blank is pushed into a pocket 29 of the folding turret 28. As can be seen from FIGS. 6 and 8, the pressure-exerting plate 30 grips the blank in the region of the rear wall 13. A special feature is that lateral corner recesses 40 mean that the pressure-exerting plate 30 is of lesser width adjacent to the base wall 16. The supporting protrusions 17 are located in this region when the blank has been pushed into the pocket 29 of the folding turret 28 (position according to FIG. 1).

During the downward movement of the blank into the pocket 29, lateral guides 41 take effect, these putting the blank parts into the upright position (U.S. Pat. No. 4,084, 393). Folding elements take effect in this region at the same time, these putting the folding web 19 into the upright position. These are folding fingers 42 which are of L-shaped design in the present case and execute the folding with the aid of an upwardly directed folding leg 43. The latter passes into the region of the folding web 19 from the underside during the downward movement of the blank. In the case of the exemplary embodiment shown, the folding leg 43 acts in the region of the leg 21 of the folding web 19. As a result, the relevant corner tab 22 is also put into the upright position, or folding position, by the folding finger 42. Thereafter, the folding fingers 42 are disengaged from the blank, to be precise by downward and sideways movement. The folding fingers 42 are provided on an actuating linkage 44 in order to execute the up and down movements. The movement is coordinated with the downward movement of the pressure-exerting plate 30, namely with the sequence of the folding operation for the blank. Once the supporting protrusions 17 have been folded into the position according to FIG. 1, the blank is folded definitively in a known manner in the region of the folding turret 28 and the pack is filled.

Figure 9:
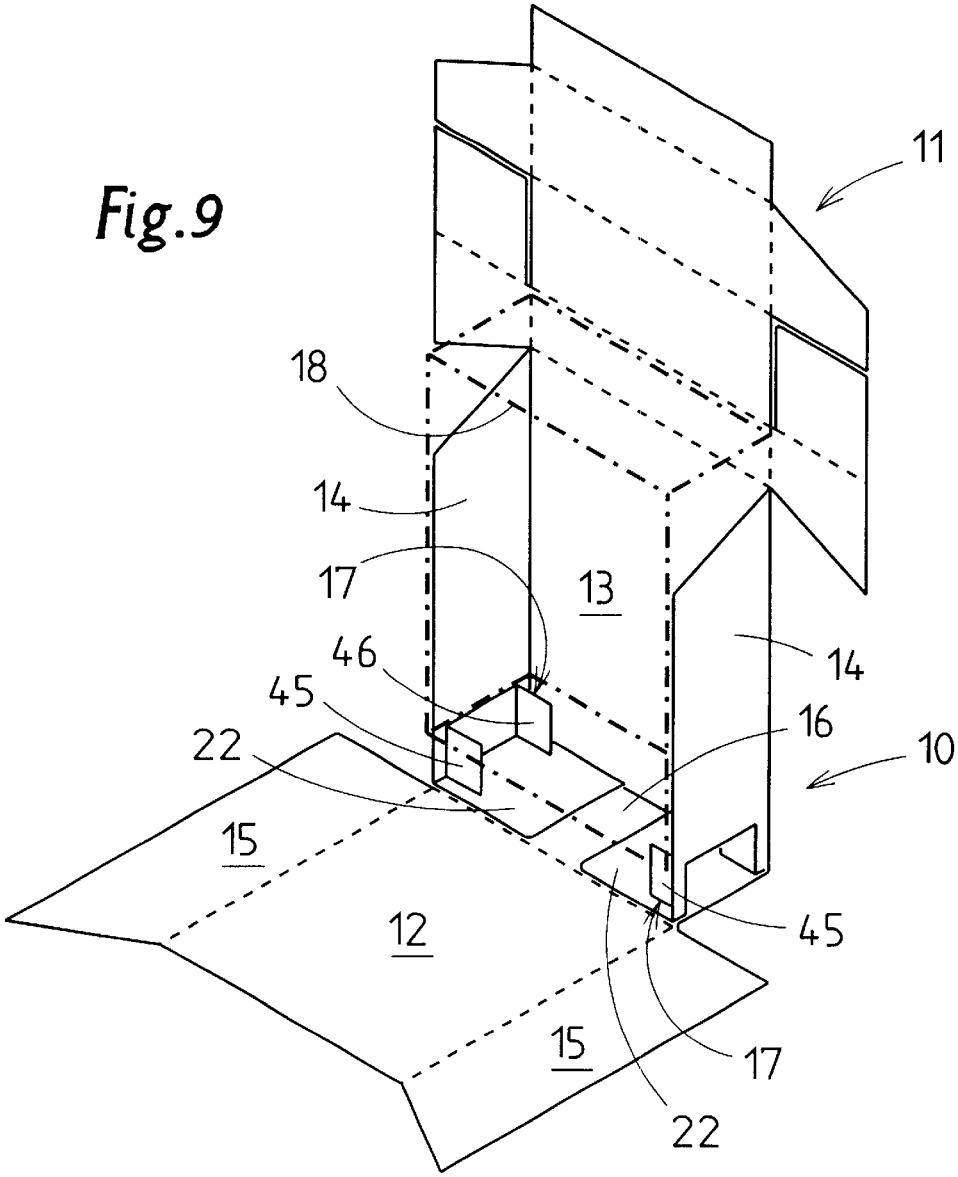
Figure 10:
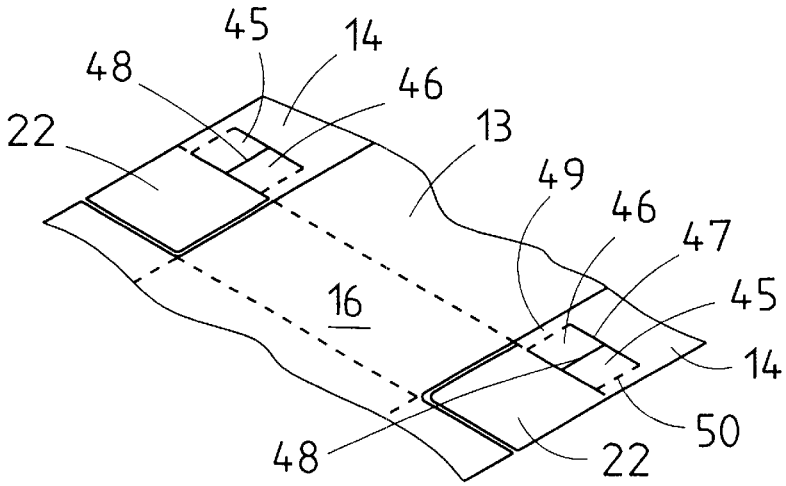

FIGS. 9 and 10 are illustrations analogous to FIGS. 1 and 2 for a different configuration of the supporting protrusions 17.

In this case, the latter comprise two folding tabs 45, 46, which are formed in the region of the (inner) side tab 14, directly above the base wall 16. The two folding tabs 45, 46 are bounded by two longitudinal punched sections 47 and a transverse punched section 48. Each folding tab 45, 46 can be folded about an articulation line 49, 50 into a position transverse to the side tab 14.

Since, in the case of this exemplary embodiment, the supporting protrusions 17 exclusively comprise a folding tab of the pack, namely the side tab 14, the folding tabs 45, 46 can be folded into the end position from the non-folded, planar blank. For this purpose, corresponding folding elements are provided in a transporting path of the blank, namely in the region of the blank path 25. A folding element, namely a folding wheel 51, is provided beneath the movement path of the blank. On a (cylindrical) circumferential surface, said folding wheel is provided centrally with a folding protrusion 52 which, on account of the rotation of the folding wheel 51, is moved against the blank from beneath, to be precise in the region of the folding tabs 45, 46. The folding protrusion 52 is provided with a cross section which tapers outwards more or less to a point or sharp edge (FIG. 12). A top or radially outer edge 53 acts on the folding tabs 45, 46 in the region of the transverse punched section 48, with the result that said folding tabs are raised into an oblique position (FIG. 12).

This first folding position of the folding tabs 45, 46 is completed by a further folding element, namely by a stationary folding shoe 54 which is positioned above the movement path of the blank and folds the pre-folded folding tabs 45, 46 into an upright position. On the side directed towards the incoming blank and/or the folding tabs 45, 46, the folding shoe 54 is provided with an end 55 which tapers to a point. Said end passes into the region between the pre-formed folding tabs 45, 46 and puts the latter into the upright position during the continued movement of the blank. For this purpose, the folding shoe 54 is of a width which corresponds approximately to the distance between the upright folding tabs 45, 46.

The blank is prepared for further processing in accordance with these folding steps, to be precise, in particular, in accordance with FIG. 3 in conjunction with U.S. Pat. No. 4,084,393.

In the case of the exemplary embodiments described hitherto, the elongate, more or less rectangular blanks are transported with their longitudinal extent oriented in the conveying direction, the regions of the lid 11 being located at the front in the conveying direction. FIGS. 14 to 18 show details of an apparatus for folding supporting protrusions 17 with the blanks conveyed transversely, that is to say with the longitudinal extent located transversely to the conveying direction. The exemplary embodiment shown is one with supporting protrusions 17 corresponding to FIGS. 9 and 10.

In the case of this configuration, the folding tabs 45 and 46 are arranged one after the other in the movement direction of the blank. Specific folding elements fold first of all one folding tab 46, which is at the rear in the conveying direction, and then the front folding tab 45.

For this purpose, a folding unit 56 is arranged beneath the movement path, namely on the underside of the blank path 25. Said folding unit has a folding element which can be moved in a number of directions, namely a folding rod 57. The folding rod 57 can be rotated about a transversely directed axis and, at the same time, can be displaced in the longitudinal direction or in the radial direction. For this purpose, the folding rod 57 is mounted displaceably in an axis-perpendicular recess of a rotary body 58. In a starting position (FIG. 14), the folding rod 57 is directed obliquely, with the top, folding end directed towards the incoming blank. As movement continues, the folding rod 57 passes, by way of rotation of the rotary body 58 and upwardly directed displacement, into the region of the folding tabs 45, 46, namely through the blank. The folding tabs 45, 46 are put into the upright position as a result. On account of the initial continuation of the oblique position, the folding tab 46, which is located at the rear in the conveying direction, is folded beyond the articulation line 49 into a rearwardly directed "over-broken" position. As movement continues, and by virtue of rotation of the rotary body 58, the folding rod 57 passes into another oblique position, oriented in the conveying direction (FIG. 18). In this position, the front folding tab 45 is deformed in the same way beyond the upright position. The folding tabs 45, 46 thus remain in the upright position once the folding rod 57 has been drawn back (FIG. 18).

The folding unit 56 interacts with mating folding elements. These are two spaced-apart folding bars 59 above the movement path of the blanks. The fixed folding bars 59 are oriented in the conveying direction of the blanks and are spaced apart from one another by a distance which corresponds approximately to the width of the folding tabs 45, 46. It is thus possible for the latter to be put into the upright position between the folding bars 59 by the folding rod 57. Those regions of the blanks which extend alongside the folding tabs 45, 46 are retained in the planar position, or in the plane of the conveying path, by the folding bar 59.

Once this folding step has been carried out, the parts of the supporting protrusions 17 are folded definitively. The blank may then be processed further in the known manner.

What is claimed is:

1. An apparatus for producing a cigarette pack by folding a non-folded blank which is made of thin cardboard or similar packaging material in a folding turret (28), and which is provided with supporting protrusions (17), in a region of a base wall (16) of the pack, for supporting a cigarette block (18) in the pack, said protrusions being formed by folding webs (19) or folding tabs (45, 46) of the blank, said apparatus comprising:

a) means for transporting a non-folded blank, with punched sections for delimiting the folding webs (19) or folding tabs (45, 46), along a blanks path (25) to the folding turret (28), b) positioned in a region of the blanks path (25), a plurality of stationary folding elements for folding or deforming the folding webs (19) or folding tabs (45, 46) during transport of the blank in a transport direction along the blanks path (25), c) disposed below the blanks path, a rotating folding element with a folding protrusion (34, 52) or a folding rod (57) which, during rotation, passes through the blank in a region of the folding webs (19) or folding tabs (45, 46) to put the folding webs (19) or folding tabs (45, 46) into an upright position, and d) a mating tool located above the blanks path in a region of the rotating folding element, e) wherein the mating tool has two supporting elements arranged at a distance from one another, said supporting elements comprising two wheel disks (37, 38), of a mating wheel (33) or of a folding bar (59), which support the blank at two sides of the folding protrusion (34, 52) or the folding rod (57).

2. The apparatus according to claim 1, further comprising, disposed above the blanks path, a plurality of additional folding elements which are located downstream of the rotating folding element (51) in the transport direction of the blank, and which complete the deformation or folding of the folding webs (19) or folding tabs (45, 46), said additional folding elements comprising fixed folding bars or folding shoes (54) which support the folding of the folding webs (19) or folding tabs (45, 46) by the relative movement of the transported blank.

3. The apparatus according to claim 1, further comprising additional folding elements for completing the deformation or folding of the folding webs (19) or folding tabs (45, 46), wherein said additional folding elements are assigned to the blank, in a region of the blanks path (25), prior to the transport of the blank to the folding turret (28), said additional folding elements comprising folding fingers (42) which are movable relative to the blank and which act upon the folding webs (19) or folding tabs (45, 46) by an upward movement from an underside of the blank.

* * * * *